US012180644B2

(12) United States Patent
Kim et al.

(10) Patent No.: US 12,180,644 B2
(45) Date of Patent: Dec. 31, 2024

(54) LAUNDRY TREATMENT APPARATUS

(71) Applicant: LG Electronics Inc., Seoul (KR)

(72) Inventors: Jaehyung Kim, Seoul (KR); Semin Jang, Seoul (KR); Jinhyuk Jang, Seoul (KR); Boram Noh, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 18/328,304

(22) Filed: Jun. 2, 2023

(65) Prior Publication Data

US 2023/0313441 A1 Oct. 5, 2023

Related U.S. Application Data

(63) Continuation of application No. 17/365,594, filed on Jul. 1, 2021, now Pat. No. 11,708,660.

(30) Foreign Application Priority Data

May 7, 2020 (KR) ..... 10-2020-0054331

(51) Int. Cl.
*D06F 71/04* (2006.01)
*D06F 58/10* (2006.01)
(Continued)

(52) U.S. Cl.
CPC ..... *D06F 71/04* (2013.01); *D06F 58/10* (2013.01); *D06F 58/203* (2013.01);
(Continued)

(58) Field of Classification Search
CPC ..... D06F 71/04; D06F 71/29; D06F 71/34; D06F 71/40; D06F 58/10; D06F 58/203; D06F 58/206
See application file for complete search history.

(56) References Cited

U.S. PATENT DOCUMENTS 5,305,484 A * 4/1994 Fitzpatrick ..... D06F 73/02 68/6
5,359,792 A 11/1994 Hanada et al.
(Continued)

FOREIGN PATENT DOCUMENTS

EP 3321415 5/2018
EP 3575480 12/2019
(Continued)

OTHER PUBLICATIONS

Extended European Search Report in European Appln. No. 21183105.2, dated Nov. 29, 2021, 8 pages.
(Continued)

*Primary Examiner* — Ismael Izaguirre
(74) *Attorney, Agent, or Firm* — Fish & Richardson P.C.

(57) ABSTRACT

The present disclosure relates to a laundry treating apparatus including a cabinet having a laundry inlet defined in one surface thereof, a first chamber positioned inside the cabinet to accommodate laundry therein through the laundry inlet, a second chamber positioned underneath the first chamber to define a space separated from a space of the first chamber, a steamer disposed inside the second chamber to generate steam and supply the generated steam to the first chamber, a door pivotably coupled to the cabinet to open and close the laundry inlet, a door inner surface facing the first chamber among both surfaces of the door, a base plate coupled to the door inner surface, a first shaft disposed parallel to a width direction of the door, a second shaft disposed parallel to the first shaft, a first pressurizing plate pivotably coupled to the door inner surface or the base plate through the first shaft and disposed to face the base plate, wherein the first pressurizing plate mounts and pressurizes pants, and a second pressurizing plate pivotably coupled to the door inner sur-
(Continued)

face or the base plate through the second shaft and disposed to face the first pressurizing plate.

17 Claims, 7 Drawing Sheets

(51) Int. Cl.
*D06F 58/20* (2006.01)
*D06F 71/29* (2006.01)
*D06F 71/34* (2006.01)
*D06F 71/40* (2006.01)

(52) U.S. Cl.
CPC ..... *D06F 58/206* (2013.01); *D06F 71/29* (2013.01); *D06F 71/34* (2013.01); *D06F 71/40* (2013.01)

(56) References Cited

U.S. PATENT DOCUMENTS 5,815,961 A * 10/1998 Estes ..... D06F 73/02 38/14
7,032,336 B2 * 4/2006 Bedretdinov ..... D06F 71/29 38/14
8,584,384 B2 * 11/2013 Savenok ..... A47G 25/72 38/19
9,309,618 B2 4/2016 Park et al.
9,359,717 B2 6/2016 Lim et al.
2019/0257025 A1 8/2019 Park

FOREIGN PATENT DOCUMENTS

| | | |
|---|---|---|
| EP | 3611300 | 2/2020 |
| JP | 2002-177698 | 6/2002 |
| KR | 10-20120091799 | 8/2012 |
| KR | 10-20190116095 | 10/2019 |
| KR | 102099179 | 4/2020 |

OTHER PUBLICATIONS

Office Action in Australian Appln. No. 2022204625, mailed on Oct. 26, 2023, 7 pages.

* cited by examiner

LAUNDRY TREATMENT APPARATUS

CROSS-REFERENCE TO RELATED APPLICATIONS

This application is a continuation of U.S. application Ser. No. 17/365,594, filed on Jul. 1, 2021, which claims the benefit of Korean Patent Application No. 10-2020-0054331, filed on May 7, 2020, the disclosures of which are incorporated by reference in their entirety.

TECHNICAL FIELD

The present disclosure relates to a laundry treating apparatus. More particularly, the present disclosure relates to an apparatus for removing wrinkles of laundry.

BACKGROUND

A laundry treating apparatus refers to an apparatus developed for washing and drying laundry and removing wrinkles generated on the laundry at home and at a laundry. Apparatuses classified as the laundry treating apparatus include a washing machine that washes the laundry, a dryer that dries the laundry, a washing machine/dryer having both a washing function and a drying function, a laundry manager that refreshes the laundry, a steamer that removes the wrinkles from the laundry, and the like.

The steamer is an apparatus that supplies steam to the laundry to remove the wrinkle generated on the laundry. Unlike a regular iron, the steamer is an apparatus that removes the wrinkles by applying heat to the laundry through convection rather than directly applying the heat to the laundry (e.g., in a scheme of contacting the laundry with a hard object).

On the other hand, the laundry manager is an apparatus that allows the laundry to be kept tidy and clean. The laundry manager may remove fine dust attached to the laundry, deodorize the laundry, dry the laundry, and add fragrance to the laundry. In addition, the laundry manager may prevent generation of static electricity, remove the wrinkles generated on the laundry using dehumidified air or steam, and sterilize the laundry.

According to Korea Patent No. 10-2099179, the laundry treating apparatus may deodorize the laundry and remove folds at the same time by supplying hot air to a supplier located at a bottom of a cabinet or by pressurizing the laundry while the laundry is mounted in an accommodating space defined inside the cabinet.

In addition, in the laundry treating apparatus, the laundry was able to be dried and deodorized or the folds was able to be removed as the hot air or the steam is supplied to the laundry treating apparatus in a state in which the laundry is unfolded by a self load thereof at a location inside the cabinet. In addition, as a surface of the laundry is pressurized with a presser disposed on an inner surface of a door, the folds of the laundry was able to be effectively removed, creases were able to be formed on the laundry, and ironing was able to be omitted after washing or drying is completed.

In particular, the laundry treating apparatus removes the unnecessary wrinkles or folds using the steam, and has means referred to the presser or a pants press that generates predetermined creases or pleats (wrinkles intended from a clothing design step) disposed on the inner surface of the door.

However, the presser is constructed to pressurize the laundry through rotation starting from one side of the laundry. Therefore, because the presser pressurizes the laundry starting from one side of the laundry, there is no choice for the presser but to pressurize the laundry sequentially from one side to the other side thereof. In this case, a relatively high pressure is applied to a portion of the laundry close to the presser, and a relatively low pressure is applied to a portion of the pressurized portion far from the presser, so that there was a problem that the laundry was not evenly pressurized.

Further, in the process of the laundry being pressurized by the presser, there was a problem in that a fixed shape of the laundry is changed or a position thereof is changed as the laundry is pushed by the presser.

In addition, there was a problem in that the position of the laundry is not able to be prevented from being changed when the laundry is pressurized because the laundry is not able to be fixed even after being mounted. In addition, the conventional laundry treating apparatus had problems in that more wrinkles of the laundry occur or wrinkles in a direction completely different from an intended direction occur.

In addition, there was a problem that a vertical level of mounting the laundry through the door is high. In addition, there was a problem that not only the presser occupies most of the inner surface of the door, but also pressurizes only a portion of an entire length of the laundry.

In addition, there was a problem that a pivoting direction of a pressurizing portion needs to be set differently depending on whether a user is left-handed or right-handed in consideration of user's convenience.

SUMMARY

The present disclosure is to reduce a frequency of unintentional wrinkles or folds occurring as laundry is pressurized from one side thereof.

In addition, the present disclosure is to uniformly pressurize laundry to remove folds or unintentional wrinkles of the laundry and to improve formation of predetermined intended creases.

In addition, the present disclosure is to pressurize an entire region of laundry.

In addition, the present disclosure is to allow the pivoting direction of the pressurizing portion not need to be set differently depending on whether the user is left-handed or right-handed.

In addition, the present disclosure is to further facilitate mounting of laundry to be pressurized.

In order to reduce a phenomenon in which pants are pushed that occurs in a conventional pants manager that is opened and closed in a left and right direction, the present disclosure is to implement a sliding motion on a pants manager door (or a second pressurizing plate). That is, the pants manager door may ascend by being pivoted or slid. At this time, a first pressurizing plate (or a sub-plate) and a base plate (or a rear plate) are spaced apart from each other. Conversely, when the door is pressurized to descend by being pivoted or slid, an entire region of the pants mounted on the first pressurizing plate is simultaneously pressurized, which has an effect of ameliorating the phenomenon in which the pants are pushed.

The pants manager door includes a locking device for pressing the pants. Unlocking of the locking device may be operated by a handle disposed on the door. When using the pants manager, the door and the first pressurizing plate may respectively include openings in order to facilitate penetration of steam into the pants, and may include a hinge for opening and closing the door in a vertical direction.

The sub-plate is a component for installing the pants, and the first pressurizing plate is able to pivot in a vertical direction using another hinge structure disposed opposite to a hinge structure responsible for the pivoting of the door. The movement in the vertical direction is in association with the pants manager door, so that the sub-plate automatically slides upward when the door is lifted. Thereafter, because the sub-plate has the hinge structure to pivot in one of the left and right directions, after pivoting and opening the sub-plate, the pants are installed.

In addition, the sub-plate has fixing clips that may fix a pant waist and a hem of the pants on both surfaces thereof. In addition, the sub-plate has fixing clips that may fix a pant waist and a hem of the pants on both surfaces thereof.

An installation process of the pants is as follows. When the handle installed at a lower end of the door is pulled to unlock the locking device, and the door is lifted upward and is fixed, the sub-plate on which the pants may be mounted is exposed. In order to install the pants, after pivoting the sub-plate in a downward direction, the hem of the pants is fixed by the fixing clip (or a first clip) installed on a rear surface of the sub-plate. The fixing clip has a structure that may be installed variably depending on a length of the pants. After fixing the hem of the pants, the pant waist is fixed by the fixing clip (or a second clip) installed on a front surface of the sub-plate.

After the pants installation is complete, the sub-plate is pivoted to be in an original state thereof, and the door of the pants manager is closed such that a pressure may be applied to the pants. In addition, because the sub-plate pivots only in the vertical direction, there is no need for a separate reversible structure in the door opening direction.

In addition, an elastic member disposed in a hinge portion may be constructed to push the sub-plate in a direction farther from the rear plate. When the door manager door is coupled to the rear plate, the door manager door pressurizes the sub-plate. At this time, because the sub-plate moves in a straight line toward the rear plate, it is possible to uniformly and simultaneously pressurize the pants.

One aspect of the present disclosure provides a laundry treating apparatus including a cabinet having a laundry inlet defined in one surface thereof, a first chamber positioned inside the cabinet to accommodate laundry therein through the laundry inlet, a second chamber positioned underneath the first chamber to define a space separated from a space of the first chamber, a steamer disposed inside the second chamber to generate steam and supply the generated steam to the first chamber, a door pivotably coupled to the cabinet to open and close the laundry inlet, a door inner surface facing the first chamber among both surfaces of the door, a base plate coupled to the door inner surface, a first shaft disposed parallel to a width direction of the door, a second shaft disposed parallel to the first shaft, a first pressurizing plate pivotably coupled to the door inner surface or the base plate through the first shaft and disposed to face the base plate, wherein the first pressurizing plate mounts and pressurizes pants, and a second pressurizing plate pivotably coupled to the door inner surface or the base plate through the second shaft and disposed to face the first pressurizing plate, wherein the second pressurizing plate pressurizes the pants.

In one implementation, the first shaft may be located on one of an upper end and a lower end of the base plate, and the second shaft may be located on the other of the upper end and the lower end of the base plate.

In one implementation, the first pressurizing plate may include a first clip located at a lower portion of one surface thereof facing the base plate, wherein the first clip fixes one of a hem and a pant waist of the pants.

In one implementation, the first pressurizing plate may include a second clip located at a lower portion of the other surface thereof facing the second pressurizing plate, wherein the second clip fixes the other of the hem and the pant waist of the pants.

In one implementation, the second clip may be formed as a clip of an angled shape to define a predetermined gap with the first pressurizing plate, and the second clip may fix the pants by inserting a portion of one side surface of the pants into the predetermined gap.

In one implementation, because a length of the second pressurizing plate is smaller than a length of the first pressurizing plate, the second clip may be exposed out of the first pressurizing plate when the second pressurizing plate is pivotably coupled to the first pressurizing plate.

In one implementation, the first pressurizing plate may include a first surface that is one surface facing the base plate, a second surface that is the other surface facing the second pressurizing plate, and a mounting corner in a curved shape for connecting the first surface and the second surface to each other, wherein the mounting corner mounts the pants, and the mounting corner may have a curvature of a curved surface connected to the first surface different from a curvature of a curved surface connected to the second surface.

In one implementation, the mounting corner may be connected to the first surface with the curved surface and may protrude toward the second pressurizing plate.

In one implementation, the first surface may include a first groove recessed in a longitudinal direction of the door to prevent interference with a seam formed on the pants, and the second surface may include a second groove recessed in the longitudinal direction of the door to prevent the interference with the seam formed on the pants.

In one implementation, the base plate may be spaced apart from the door inner surface by a predetermined separation distance and may be coupled to the door inner surface.

In one implementation, the base plate may include a clip accommodating portion recessed or penetrated into a shape corresponding to a shape of the first clip when the first pressurizing plate pressurizes the base plate.

In one implementation, the laundry treating apparatus may further include an elastic support positioned between the base plate and the door inner surface to support the base plate, and the pants may be pressurized between the first pressurizing plate and the base plate when the first pressurizing plate is coupled to the base plate.

In one implementation, a width of the second pressurizing plate may be greater than widths of the first pressurizing plate and the base plate.

In one implementation, the laundry treating apparatus may further include a blower disposed inside the second chamber to suck air in the first chamber, a heat pump disposed inside the second chamber to dehumidify and heat the sucked air, a first opening penetrating the first pressurizing plate, and a second opening penetrating the second pressurizing plate at a position corresponding to a position of the first opening, and the pants may be exposed to dehumidified and heated air and steam through the first opening and the second opening.

In one implementation, the second pressurizing plate may include protective side surfaces formed by being bent in a direction toward the door inner surface from both side surfaces of the second pressurizing plate, respectively, and the protective side surfaces may cover both side surfaces of the base plate and both side surfaces of the first pressurizing plate when the second pressurizing plate pressurizes the first pressurizing plate and the base plate.

In one implementation, a cover surface located on a side away from the door inner surface among both surfaces of the second pressurizing plate may further include a handle for a user to hold the second pressurizing plate to pivot the second pressurizing plate.

In one implementation, the first pressing plate may include a hinge portion including the first shaft, wherein the hinge portion is disposed beneath the first pressurizing plate to move the first pressurizing plate in a direction farther from or closer to the door inner surface.

In one implementation, the hinge portion may further include a hinge support coupled to the base plate or the door inner surface to support the first shaft, and a hinge hole penetrating the hinge support in an axial direction of the first shaft, wherein the first shaft is inserted into the hinge hole, and a length of the hinge hole measured along the direction farther from or closer to the door inner surface may be greater than a length of the hinge hole measured along a height direction of the door.

In one implementation, the hinge portion may further include an elastic member for applying an elastic force to the first pressurizing plate in the direction farther from the door inner surface, the first pressurizing plate may move toward the base plate while facing the base plate along the hinge hole when the second pressurizing plate is coupled to the first pressurizing plate or the base plate, and the first pressurizing plate may move in a direction farther from the base plate while facing the base plate by the elastic member when the second pressurizing plate pivots in a direction farther from the first pressurizing plate.

In one implementation, the hinge portion may further include a hinge connecting portion of an angled shape for connecting the first shaft and the first pressurizing plate to each other, and the hinge connecting portion may prevent the first pressurizing plate from pivoting by an angle equal to or greater than a predetermined angle when the first pressurizing plate pivots in a direction farther from the base plate.

The present disclosure may reduce the frequency of the unintentional wrinkles or folds occurring as the laundry is pressurized from said one side thereof.

In addition, the present disclosure may uniformly pressurize the laundry to remove the folds or the unintentional wrinkles of the laundry and improve the formation of the predetermined intended creases.

In addition, the present disclosure may pressurize the entire region of the laundry.

In addition, the present disclosure may not need to differently set the pivoting direction of the pressurizing portion depending on whether the user is left-handed or right-handed.

In addition, the present disclosure may further facilitate the mounting of the laundry to be pressurized.

DETAILED DESCRIPTION

Hereinafter, a preferred embodiment of the present disclosure will be described in detail with reference to the accompanying drawings. A configuration of an apparatus or a method for controlling the same to be described below is only for describing the embodiment of the present disclosure, not for limiting the scope of the present disclosure, and reference numbers used the same throughout the specification refer to like components.

Specific terms used in the present specification are only for convenience of description and are not used as a limitation of the illustrated embodiment.

For example, expressions such as "same" and "identical" not only indicate the strictly identical state, but also indicate a state in which a tolerance or a difference in the degree of obtaining the same function exists.

For example, expressions such as "in a certain direction", "along a certain direction", "parallel to", "vertically", "central", "concentric", or "coaxial" indicating a relative or absolute arrangement not only strictly indicate such an arrangement, but also indicate a state in which a relative displacement is carried out with a tolerance or an angle or a distance sufficient to obtain the same function.

A term 'wrinkles' used herein without being expressly stated refers to unintentional wrinkles or folds that occur after clothing is worn, or after washing or drying. In other words, the term 'wrinkles' refers to wrinkles that occur unintentionally as the clothing is wrinkled by use or during the washing or the drying, rather than pleats or creases intended for a design or a function from a design step. Therefore, the term 'wrinkles' refers to the folds that need to be removed using a method such as ironing.

Figure 1B:
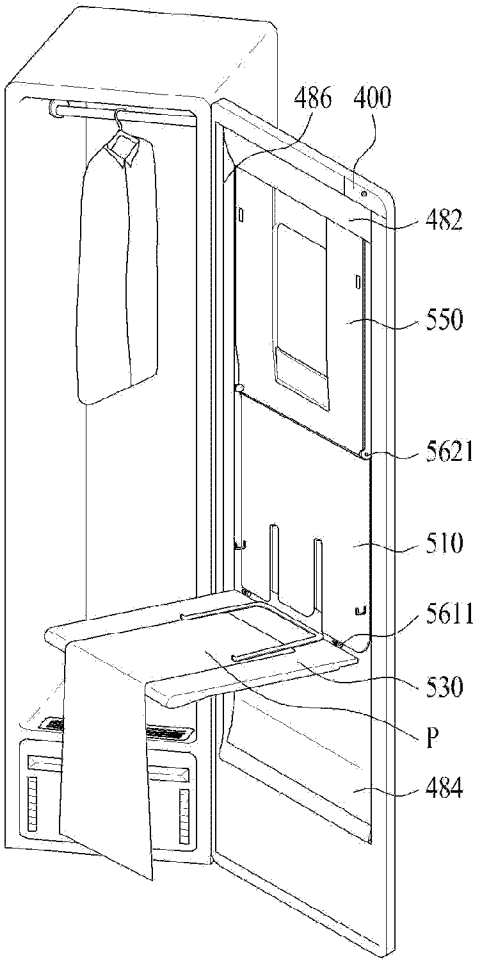
FIG. 1B shows a state in which a second pressurizing plate is opened and a first pressurizing plate is pivoted to mount laundry using a pressurizing portion, which is a feature of the present disclosure.
Figure 1A:
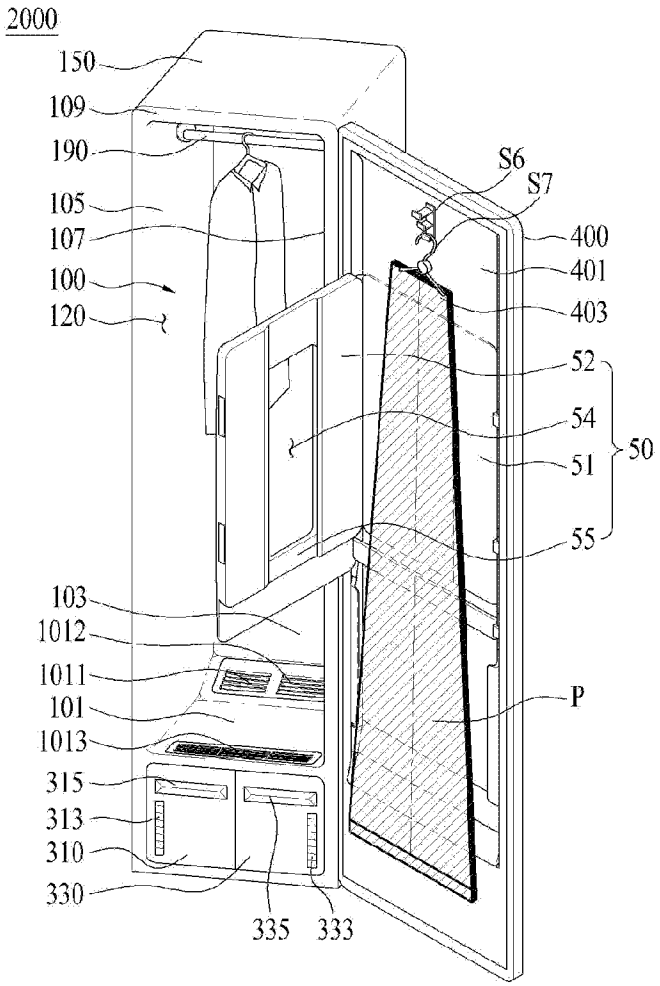
FIG. 1A shows an example of a conventional laundry treating apparatus and an example of a presser for removing wrinkles of laundry.

FIG. 1A shows an example of a conventional laundry treating apparatus 2000. The laundry treating apparatus 2000 includes a cabinet 150 including a laundry inlet 120 defined in one surface thereof, a first chamber 100 positioned inside the cabinet 150 and accommodating laundry through the laundry inlet 120, a second chamber 200 positioned underneath the first chamber 100 and defining a space therein separated from a space defined in the first chamber 100, a steamer 250 (see FIG. 2) that is disposed in the second chamber 200, generates steam, and supplies the steam to the first chamber 100, and a door 400 that is pivotably coupled to the cabinet 150 to open and close the laundry inlet 120. Considering usage methods of general users, preferably, the laundry inlet 120 will be defined in a front surface of the cabinet 150.

In addition, the laundry treating apparatus 2000 may further include a blower 220 (see FIG. 2) located inside the second chamber 200 and sucking air of the first chamber 100, and a heat pump unit 230 that dehumidifies and heats the sucked air and then discharges the air to the first chamber 100.

The cabinet 150 may be made of a metal material, and may be made of a plastic material when strength thereof is able to be maintained. In addition, the first chamber 100 may be formed by plastic injection molding. The first chamber 100 may be coupled to the cabinet 150 by a frame (not shown). Alternatively, a space between the cabinet 150 and the first chamber 100 may be filled with a foamed plastic such as polyurethane.

The laundry including tops and bottoms may be placed in the first chamber 100, and the laundry may be managed to be refreshed through the blower 220 (see FIG. 2), the heat pump 230 (see FIG. 2), and the steamer 250 (see FIG. 2) located inside the second chamber 200. That is, a function of sterilizing and deodorizing the laundry using the steam and/or heated air, and removing the folds formed by use may be performed through the blower 220 (see FIG. 2), the heat pump 230 (see FIG. 2), and the steamer 250 (see FIG. 2) located inside the second chamber 200.

The first chamber 100 may include a laundry support 190 for mounting the laundry at an upper portion of an interior of the first chamber 100. The laundry support 190 may accommodate a hanger on which the laundry is hung, and may be connected to a driver (not shown) capable of reciprocating the laundry support 190 in a left and right direction. The movement of the laundry support 190 may shake the laundry, and eventually foreign matters including fine dust attached to the laundry may be separated. In addition, while shaking the laundry mounted on the laundry support 190, the wrinkles of the laundry may be removed to some extent by being exposed to the steam or moisture supplied from the second chamber 200.

That is, the laundry support 190 allows the laundry to be mounted in an unfolded state by a self load thereof at the interior of the first chamber 100, thereby allowing the laundry to be uniformly exposed to the dehumidified and heated air and/or steam supplied from the second chamber 200.

In general, water boils at 100° C. under atmospheric pressure. In this connection, generated water vapor may be referred to as the steam. Moisture, on the other hand, refers to a form in which water droplets of 1 mm or less are suspended in the air at room temperature. For example, the moisture is like fog. In general, because the steam generated by boiling water has a greater sterilization power than the moisture because of a higher temperature, and water molecules move more actively at high temperature, permeability of the laundry is excellent for the case of the steam, so that the steam may be utilized more than the moisture to refresh the laundry.

The first chamber 100 is formed by a first chamber top surface 109 on which the driver (not shown) of the laundry support 190 is located, a first chamber bottom surface 101 that forms a bottom of the first chamber 100, first chamber left and right side surfaces 105 and 107 that connect the first chamber top surface 109 and the first chamber bottom surface 101 to each other, and a first chamber rear surface 103. When said one surface in which the laundry inlet 120 is defined is the front surface, the rear surface of the first chamber 103 will be located on a side opposite to the front surface.

An air supply port 1011 and a steam supply port 1012 for supplying the steam generated by the steamer 250 and the air dehumidified and heated by the heat pump 230 in the second chamber 200 to the first chamber, and an air suction port 1013 for sucking the air of the first chamber 100 by the blower 220 may be located on the first chamber bottom surface 101.

As shown in FIG. 1A, the air supply port 1011 and the steam supply port 1012 may be disposed in a region where the first chamber bottom surface 101 and the first chamber rear surface 103 meet. In addition, the region where the first chamber bottom surface 101 and the first chamber rear surface 103 meet may have a smoothly inclined shape. The air suction port 1013 may be located on the first chamber bottom surface 101 close to the laundry inlet 120. Accordingly, the air inside the first chamber 100 will be discharged through the air supply port 1011 and then sucked through the air suction port 1013 to circulate. The steam will also be discharged through the steam supply port 1012, then condensed, then sucked through the air suction port 1013, and then collected in a sump (not shown) for storing condensate therein.

In order to more smoothly discharge the condensate condensed inside the first chamber 100 into the second chamber 200 through the air suction port 1013, the first chamber bottom surface 101 may be inclined downward in a direction of the laundry inlet 120 from the first chamber rear surface 103.

As shown in FIG. 1A, the laundry treating apparatus 2000 may include a water supply tank 310 for supplying water to the steamer 250 and a drain tank 330 for discharging and storing the condensate collected in the sump (not shown) at a front portion of the second chamber 200. In addition, a tank module frame (not shown) for defining a tank installation space (not shown) in which the water supply tank 310 and the drain tank 330 are installed may be disposed to separate the tank installation space (not shown) and the second chamber 200 from each other. That is, the tank installation space 351 and the second chamber 200 may be located underneath the first chamber 100, and the tank installation space may be located close to the door 400 and the second chamber 200 may be located at the rear of the tank installation space.

Each of the water supply tank 310 and the drain tank 330 may be constructed to be detachable from the tank module frame (not shown). However, alternatively, the water supply tank 310 and the drain tank 330 may be coupled to each other to be attached or detached at the same time.

The door 400 may include a rear surface of the door 400 or a door inner surface 401 directed in a direction from the door 400 to the first chamber 100 when the door 400 is closed. The door 400 will be pivotably connected to the cabinet 150 in a hinge scheme to open and close the laundry inlet 120.

When a user closes the door 400, a front surface of the water supply tank 310 and a front surface of the drain tank 330 may face the door inner surface 401. When the user opens the door 400, the front surface of the water supply tank 310 and the front surface of the drain tank 330 may be exposed to the outside. In addition, the water supply tank 310 and the drain tank 330 include a water supply tank window 313 and a drain tank window 333 on the front surfaces thereof, respectively, so that water levels of the water stored inside the water supply tank 310 and the drain tank 330 may be identified immediately.

A water supply tank handle 315 and a drain tank handle 335 may be disposed on the front surface of the water supply tank 310 and the front surface of the drain tank 330, respectively. When the user pulls each of the water supply tank handle 315 and the drain tank handle 335, each of the water supply tank 310 and the drain tank 330 may be separated from the tank module frame (not shown) by pivoting about each of a distal end of the front surface of the water supply tank and a distal end of the front surface of the drain tank. In addition, when mounting the water supply tank 310 and the drain tank 330 on the tank module frame (not shown), the water supply tank 310 and the drain tank 330 will be seated on the tank module frame (not shown) through the pivoting as well.

In the case of the conventional laundry treating apparatus 2000, a laundry fixing portion 405 for hanging a laundry hanger 403 after mounting pants P upside down on the laundry hanger 403, and a presser 50 for pressurizing the pants fixed by the hanger 403 may be located on the door inner surface 401 or inside the first chamber 100.

The reason for hanging the pants P upside down, that is, with a bottom hem up, is to allow the pants P to be evenly unfolded as a tensile force is applied thereto through a self load of the pants P because a weight of an upper end, that is, a pant waist of the pants P is greater than a weight of a lower end, that is, pant legs of the pants P.

The presser 50 may include a support plate 51 coupled to the door inner surface 401 and supporting the laundry, and a pivoting plate 52 pivoting toward the support plate 51 to pressurize the pants P. When the pivoting plate 52 pivots toward and is coupled to the support plate 51, the pivoting plate 52 becomes able to pressurize the pants P. Thereafter, as the door 400 is closed, the fold may be removed by being exposed to the steam and the dehumidified and heated air inside the first chamber 100. In this connection, the presser 50 may include a pivoting plate through-hole 54 penetrating the pivoting plate 52 to facilitate penetration of the steam into the pants P, and may further include a depression 55 defined in a surface in contact with the pants P of both surfaces of the pivoting plate in order to prevent a seam formed along a longitudinal direction of the pant legs of the pants P from being pressurized.

Figure 2:
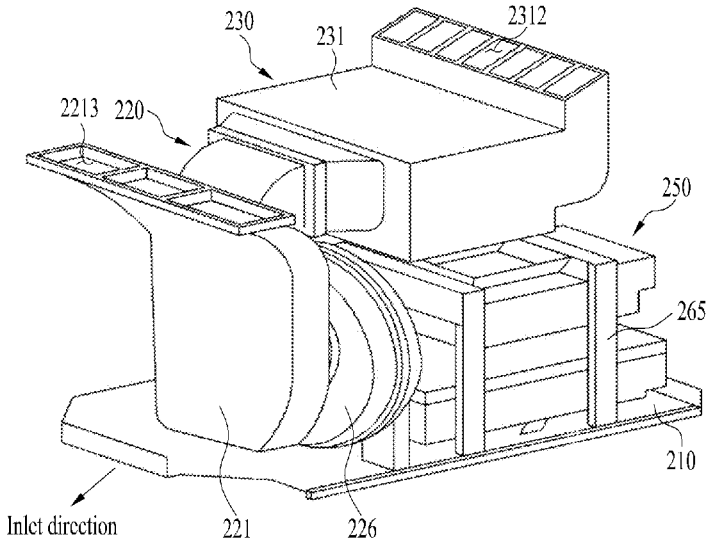
FIG. 2 shows an example of a blower, a heat pump, and a steamer mounted inside a second chamber.

Referring to FIG. 2, the blower 220 for sucking the air of the first chamber 100, the steamer 250 for receiving water from the water supply tank 310, generating the steam, and then, supplying the steam to the first chamber 100, and the heat pump 230 for dehumidifying and heating the air sucked by the blower 220 and discharging the air to the first chamber 100 may be included inside the second chamber 200. In addition, a controller (not shown) for controlling the blower 220, the steamer 250, and the heat pump 230 may be located.

Therefore, in order to supply the dehumidified and heated air to the first chamber 100, the air inside the first chamber 100 is sucked through an inlet duct 221 after generating a suction force using a blower fan 226. Then, the air is flowed to the heat pump 230, then is subjected to heat exchange, and then, is supplied to the first chamber 100 again.

Referring to FIG. 2, the blower 220 may include the blower fan 226 and the inlet duct 221. When a side on which the laundry inlet 120 is located is referred to as a front side, and a side on which the rear surface of the first chamber is located is referred to as a rear side, the inlet duct 221 may be disposed in front of the blower fan 226, and the tank module frame (not shown) may be disposed in front of the inlet duct 221. Accordingly, the tank module frame may separate the tank installation space 351 and the second chamber 200 from each other.

The water supply tank 310 and the drain tank 330 seated on the tank module frame may be located closer to one of both side surfaces of the cabinet 150. For example, in the tank installation space (not shown), a right side surface of the cabinet 150 may be located closer to the water supply tank 310 than a left side surface of the cabinet. Conversely, the left side surface of the cabinet 150 may be located closer to the drain tank 330 than the right side surface of the cabinet.

Inside the second chamber 200, the right side surface of the cabinet 150 may also be located closer to the steamer 250 than the left side surface of the cabinet 150 in the same manner as the location of the water supply tank 310. This is to simplify a connection flow channel through which water flows from the water supply tank 310 to the steamer 250 by disposing the steamer 250 at the rear of the water supply tank 310.

The steamer 250 may heat water located inside the steamer 250 using a heater, and the generated steam may be in communication with the steam supply port 1012 disposed on the first chamber bottom surface 101 along a steam flow channel (not shown).

When the water supply tank 310 is located closer to the left side surface of the cabinet 150 than to the right side surface of the cabinet 150, the steamer may also correspondingly be located closer to the left side surface of the cabinet 150 than to the right side surface of the cabinet 150.

In addition, the inlet duct 221 may include an inlet duct entrance 2213 that communicates with the air suction port 1013 disposed on the first chamber bottom surface 101 and sucks the air of the first chamber 100. In addition, the inlet duct entrance 2213 may define an inclined flow channel therein. This is to easily flow the condensate generated in the first chamber 100 and on the door 400 to a sump (not shown) disposed inside of and in a lower portion of the inlet duct 221 along the inclined flow channel after passing through the inlet duct entrance 2213 in communication with the first chamber bottom surface 101.

The inlet duct 221 may be positioned in front of the blower fan 226, and the steamer 250 and the heat pump 230 may be disposed at the rear of the blower fan 226. In addition, the heat pump 230 may be supported by a supporter 265. The supporter 265 may be disposed on a base 210 forming a bottom of the second chamber 200. Therefore, the supporter 265 may form a predetermined separation distance between the base 210 and the heat pump 230, and define a predetermined installation space between the supporter 265 and the base portion 210. The steamer 250 may be located in the installation space, and may be coupled to the supporter 265 in the installation space. FIG. 2 shows an example in which the controller 270 is positioned underneath the steamer 250 in the installation space of the supporter 265, but the controller 270 is able to be installed anywhere inside the second chamber 200 such as a location at the rear of the steamer 250.

The heat pump 230 may further include a housing 231 having a first heat exchanger (or an evaporator) (not shown) and a second heat exchanger (or a condenser) (not shown) therein, and an air outlet 2312 in communication with the air supply port 1011 disposed in the first chamber 100 to discharge the dehumidified and heated air from the housing 231 to the first chamber 100. A compressor (not shown) and an expansion valve (not shown) for circulating a refrigerant may be located outward of the supporter 265.

Unlike as shown in FIG. 2, the blower may circulate the air of the first chamber, and the evaporator and the condenser may be disposed inside a duct for flowing the air circulated by the blower. That is, the blower may be composed of the inlet duct 221, the blower fan 226, a connection duct (corresponding to the housing in FIG. 2) and an exhaust duct (corresponding to the air outlet in FIG. 2), and the heat pump may include the evaporator and the condenser disposed inside the connection duct, and the compressor and an expansion portion disposed outside the blower.

Referring to FIG. 1B, the door 400 may include the door inner surface 401 directed in the direction from the door 400 to the first chamber 100, a door gasket 486 disposed on the door inner surface 401 and in close contact with an edge of the cabinet 150 to form a sealing between the door 400 and the cabinet 150, and door liners 482 and 484 disposed on the door inner surface 401 to guide the condensate generated in the first chamber 100 to the first chamber bottom surface 101 when the door 400 is closed. In some embodiments, the door 400 has a structure that may open and close the first chamber 100 and the tank installation space 351 at the same time. In another embodiment, a plurality of doors may be installed in the cabinet 150, and independently open and close the first chamber 100 and the tank installation space 351, respectively. The door liners 482 and 484 may be constructed to face the first chamber 100 when the door 400 is closed, and may include an upper door liner 482 and a lower door liner 484. The door liners 482 and 484 may discharge the condensate generated on surfaces of the door liners 482 and 484 to the sump (not shown) disposed in the lower portion of the inlet duct through the air suction port 1013 disposed on the first chamber bottom surface 101.

The door gasket 486 may be mounted on the door inner surface 401 to surround the door inner surface 401. The sealing between the door 400 and the cabinet 150 may be achieved by the door gasket 486. In addition, the door gasket 486 may individually seal the first chamber 100 and the tank installation space 351.

In addition, FIG. 1B shows a laundry treating apparatus 1000, which is an embodiment of the present disclosure, and shows an example of a pressurizing portion 500 different from the presser 50 constructed in the conventional laundry treating apparatus 2000 to remove the wrinkles of the pants.

That is, the laundry treating apparatus 1000 includes the cabinet 150 including the laundry inlet 120 defined in one surface thereof, the first chamber 100 positioned inside the cabinet 150 to accommodate the laundry through the laundry inlet 120, the second chamber 200 positioned underneath the first chamber 100 to define the space separated from the space of the first chamber 100, the steamer 250 (see FIG. 2) disposed inside the second chamber 200 to generate the steam and supply the steam to the first chamber, the door 400 pivotably coupled to the cabinet 150 to open and close the laundry inlet 120, the door inner surface 401 directed in the direction toward the first chamber 100 among both surfaces of the door, a base plate 510 coupled to the door inner surface 401, a first shaft 5611 disposed parallel to a width direction of the door 400, a second shaft 5621 disposed perpendicular to the first shaft 5611, a first pressurizing plate 530 pivotably coupled to the door inner surface 401 or the base plate 510 through the first shaft 5611 to face the base plate 510, and mounting and pressurizing the pants P, and a second pressurizing plate 550 pivotably coupled to the door inner surface 401 or the base plate 510 through the second shaft 5621 to face the first pressurizing plate 530.

The second pressurizing plate 550 may be coupled to the base plate 510 and/or the first pressurizing plate 530 to pressurize the base plate 510 and/or the first pressurizing plate 530, but may be simply coupled to the base plate 510 and/or the first pressurizing plate 530 to protect the pants mounted on the first pressurizing plate 530, or to perform only a cover role for protecting the base plate 510 and/or the first pressurizing plate 530.

In particular, the pressurizing portion 500 includes the base plate 510 coupled to the door inner surface 401, the first shaft 5611 disposed parallel to the width direction of the door 400, the second shaft 5621 disposed parallel to the first shaft 5611, the first pressurizing plate 530 pivotably coupled to the door inner surface 401 or the base plate 510 through the first shaft 5611 (see FIG. 6) to face the base plate 510, and mounting and pressurizing the pants, and the second pressurizing plate 550 pivotably coupled to the door inner surface 401 or the base plate 510 through the second shaft 5621 to face the first pressurizing plate 530, and pressurizing the pants.

Roughly, the pressurizing portion 500 may include the second pressurizing plate 550 that may pivot in a vertical direction of the door 400, the first pressurizing plate 530 that may pivot in the vertical direction of the door 400, and the base plate 510 coupled to the door inner surface. The first pressurizing plate 530 and the second pressurizing plate 550 may pivot around the first shaft 5611 constructed along the width direction of the door, and the second shaft 5621 constructed parallel to the first shaft 5611, respectively.

The first shaft 5611 and the second shaft 5621 may all be disposed parallel to the width direction of the door. In addition, the first shaft 5611 and the second shaft 5621 may be disposed at the same position. However, in consideration of user convenience, the first pressurizing plate 530 and the second pressurizing plate 550 may be opened and closed with different pivoting directions at different positions. Accordingly, in FIG. 1B, the first shaft 5611 may be disposed underneath the base plate 510, and the second shaft 5621 may be disposed on top of the base plate 510. Therefore, when the second pressurizing plate 550 is opened by pivoting upward around the second shaft 5621, the first pressurizing plate 530 may pivot downward around the first shaft 5611. Accordingly, interference between the first pressurizing plate 530 and the second pressurizing plate 550 may be prevented during the pivoting.

When the second pressurizing plate 550 pivots along a width direction of the door 400—pivots around an axial direction of the second shaft—, the first pressurizing plate 530 capable of mounting and fixing the pants may be exposed. In this connection, the first pressurizing plate 530 may be pivoted by the first shaft 5611 while maintaining a constant distance between the first pressurizing plate 530 and one side surface of the door 400. That is, the first pressurizing plate 530 may pivot in the vertical direction that is perpendicular to the left and right direction, which is an opening and closing direction of the door 400.

FIG. 1B shows an example in which the first pressurizing plate 530 pivots around the first shaft 5611 disposed at a lower portion of the first pressurizing plate 530, and the second pressurizing plate 550 pivots around the second shaft 5621 disposed above the second pressurizing plate 550, but the first shaft 5611 may be disposed at an upper portion of the first pressurizing plate 530, and the second shaft 5621 may be disposed below the second pressurizing plate 550. That is, when the first pressurizing plate 530 and the second pressurizing plate 550 pivot around axial directions thereof by the first shaft 5611 and the second shaft 5621, the location of the second shaft 5621 and which side surface the first shaft 5611 is located on may not be important.

As above, when the first pressurizing plate 530 and the second pressurizing plate 550 pivot in the vertical direction, there is no need to set the pivoting direction differently depending on whether the user is left-handed or right-handed. A feature that the pivoting direction may be set differently based on user's selection is referred to as reversible. In the laundry treating apparatus, which is an embodiment of the present disclosure, whether to pivot the door 400 to the left or to the right is selectable based on the user's selection. However, because the components of the pressurizing portion 500 are opened and closed by being pivoted in the vertical direction, there is no need to consider this.

In this specification, pivoting in the vertical direction of the door 400 means pivoting around the shaft formed parallel to the width direction of the door 400, and pivoting in the left and right direction of the door 400 means pivoting around the shaft formed parallel to the height direction of the door 400. The height direction of the door 400 and the width direction of the door 400 are perpendicular to each other. Accordingly, the first shaft 5611 and the second shaft 5621 are perpendicular to each other.

In addition, in this specification, penetrating in the thickness direction means penetrating a top surface and a bottom surface, which are formed by horizontal sides and vertical sides of a member having a very large height (or thickness) like a plate-shaped member, in a direction from the top surface to the bottom surface or from the bottom surface to the top surface direction.

Figure 3A:
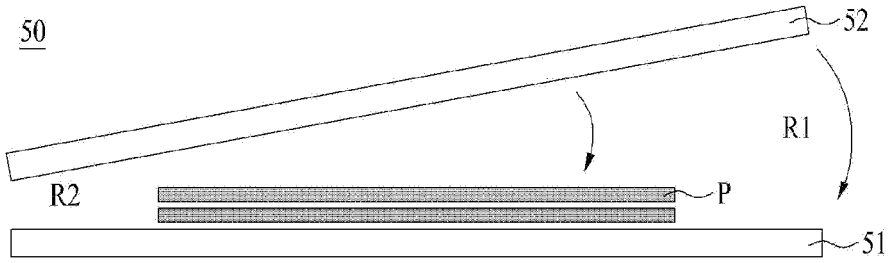
FIGS. 3A and 3B schematically show a problem that occurs as pants are pressurized starting from one side thereof in a conventional laundry treating apparatus.
Figure 3B:
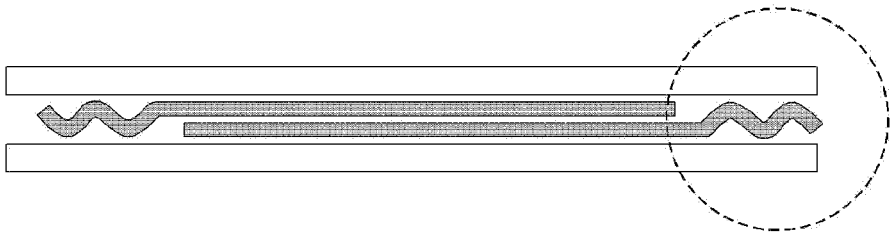

FIGS. 3A and 3B schematically shows the presser 50 of the conventional laundry treating apparatus 2000. In particular, FIG. 3A shows a state in which the pivoting plate 52 pivots toward the support plate 51 on which the pants P are mounted, and FIG. 3B schematically shows a state in which the pivoting plate 52 is pivoted and coupled to the support plate 51 to pressurize the pants P located between the pivoting plate 52 and the support plate 51.

The pivoting plate 52 pivots through a pivoting coupling portion (not shown), for example, a hinge, disposed on one of both side surfaces of the pivoting plate 52 to pressurize the pants P. In this connection, the pants P will be pressurized from one side surface where the pivoting coupling portion is located. That is, the pants P are pressurized from a region R2 close to the pivoting coupling portion. When the pivoting plate 52 is completely pivoted to face the support plate 51, that is, when the other side surface of the pivoting plate 52 is coupled to the support plate 51, the pants P will be pressurized up to a region R1.

Therefore, while the pivoting plate 52 pivots, a uniform pressure is not applied to the pants P. In this case, a relatively large pressure is applied to a portion (the region R1) of the pants P close to the pivoting coupling portion, and a relatively small pressure is applied to a portion (the region R2) far from the pivoting coupling portion, so that the pants P may not be evenly pressurized.

Further, in the process of the pants P being pressurized by the pivoting plate 52, the pants may be pushed by the pivoting plate 52, which may cause a problem that a fixed shape of the laundry is changed or a position of the laundry is changed. Therefore, in the conventional laundry treating apparatus 2000, as indicated by a dotted circle in FIG. 3B, more wrinkles of the laundry may occur or wrinkles in directions completely different from the intended direction may occur. FIG. 3B is exaggerated to emphasize such a case.

In addition, even when the pants P are mounted, the pants P are simply hung on a laundry mounting portion 56 (see FIG. 1A), but are not able to be fixed, so that the position of the laundry is not able to be prevented from changing during pressurization.

In addition, when the pants P are mounted on the inner surface of the door with a total length of the pants without being folded, because a vertical level of the laundry mounting portion 56 (see FIG. 1A) is high, there may be an inconvenience for the user. In addition, because the laundry mounting portion 56 occupies most of the door inner surface 401, there is a problem in that usability of the door inner surface 401 may be deteriorated.

The present disclosure relates to an example of the laundry treating apparatus 1000 including the pressurizing portion 500 shown in FIG. 1B to solve the above-described problems. Because the pressurizing portion 500 may fold the pants through the first pressurizing plate 530, the space occupied by the pressurizing portion 500 or the pants P on the door inner surface 401 may be reduced by about half.

In one example, the pants P may be fixed through a clip or the like disposed on the first pressurizing plate 530. In addition, even when the pressurizing plate 530 pivots along the width direction of the door perpendicular to the pivoting direction of the door 400, that is, around the first shaft, the first pressurizing plate 530 will not immediately pressurize the pants P by being coupled to the base plate 510, but will maintain a predetermined distance (L1, see FIGS. 7A and 7B) with the base plate 510. This is because an elastic force is applied in a direction in which the first pressurizing plate 530 moves away from the base plate 510 by an elastic member 5618 (see FIG. 6) disposed in the first pivoting portion 561 (see FIG. 6) of the first pressurizing plate 530.

When the second pressurizing plate 550 is closed to be coupled to the base plate 510 in order to overcome the elastic force, the first pressurizing plate 530 will move toward the base plate 510. Therefore, the first pressurizing plate 530 will be uniformly in close contact with the base plate 510 rather than a portion of the first pressurizing plate 530 first contacts the base plate 510. Thus, an entire region of the pants P will be pressurized uniformly at the same time. This will be described later in detail with reference to FIGS. 6 to 7B.

FIGS. 4A to 4E sequentially shows a method of using the pressurizing portion 500 disposed on the door 400 to remove the wrinkles of the pants P. The pressurizing portion 500 may be disposed on the door inner surface 401 or the first chamber side surface 105, but FIGS. 4A to 4E shows an example in which the pressurizing portion 500 is disposed on the door inner surface 401.

Figures 4A, 4B, 4C, 4D, 4E:
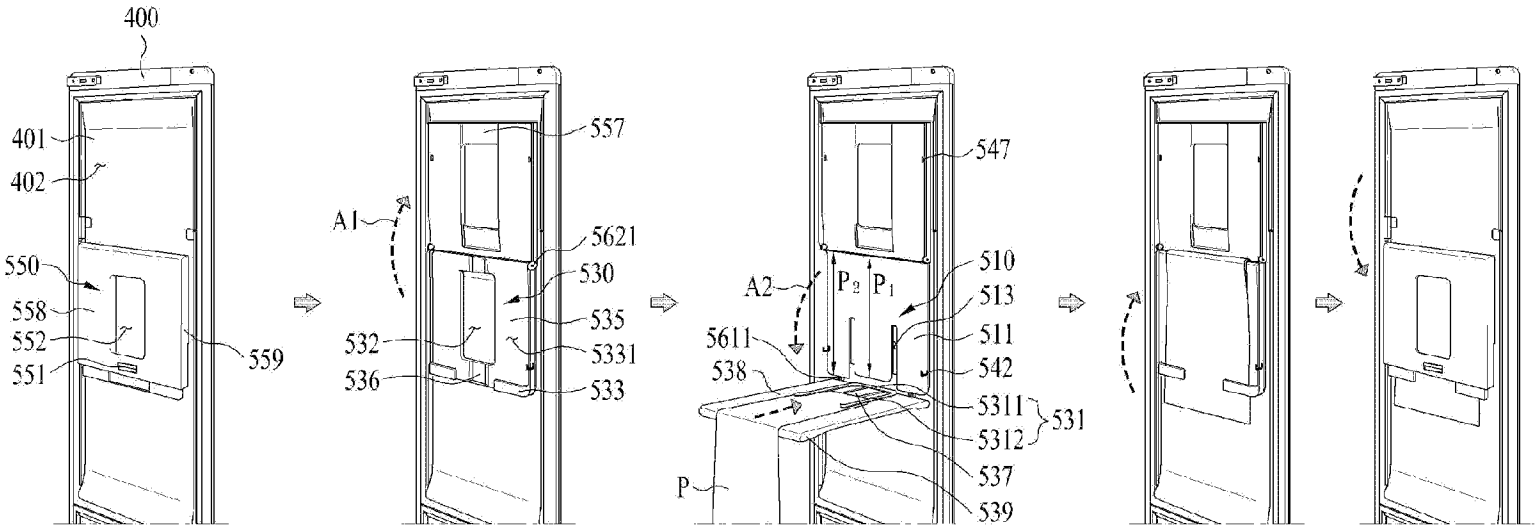
FIGS. 4A to 4E list a method for using a pressurizing portion, which is an embodiment of the present disclosure, in order.

Referring to FIG. 4C, the pressurizing portion 500 includes the base plate 510 coupled to the door inner surface 401, the first shaft 5611 disposed parallel to the width direction of the door 400, the second shaft 5621 disposed parallel to the first shaft 5611, the first pressurizing plate 530 pivotably coupled to the door inner surface 401 or the base plate 510 through the first shaft 5611 to face the base plate 510, and mounting and pressurizing the pants, and the second pressurizing plate 550 pivotably coupled to the door inner surface 401 or the base plate 510 through the second shaft 5621 to face the first pressurizing plate 530. Accordingly, the pivoting direction of the pressurizing portion 500 is perpendicular to the pivoting direction of the door 400.

Considering only the pressurizing portion 500, the pressurizing portion 500 may include the second pressurizing plate 550 that may pivot in the vertical direction on the door inner surface 401, the first pressurizing plate 530 that may pivot in the vertical direction on the door inner surface 401, and the base plate 510 coupled to the door inner surface. The first pressurizing plate 530 and the second pressurizing plate 550 may pivot around the first shaft 5611 constructed along the width direction of the door, and the second shaft 5621 constructed parallel to the first shaft 5611, respectively.

Referring to FIGS. 4A and 4B, when the door 400 is opened, the second pressurizing plate 550 of the pressurizing portion 500 may be exposed to the outside. Accordingly, the second pressurizing plate 550 may function as a cover for protecting the base plate 510 and the first pressurizing plate 530. In addition, the second pressurizing plate 550 may also perform a function of pressurizing a portion including the pant waist when the pants P are mounted as shown in FIG. 4C. The second pressurizing plate 550 may include a pressurizing surface 555 facing the pants and a cover surface 558 located on an opposite side of the pressurizing surface. The second pressurizing plate 550 may further include a second opening 552 defined therein that penetrates the second pressurizing plate 550 in a thickness direction of the second pressurizing plate 550, that is, in a direction from the pressurizing surface 555 to the cover surface 558. The second opening 552 may facilitate the penetration of the steam into the pants P mounted in the pressurizing portion 500 together with a first opening 532, which will be described later, penetrating the first pressurizing plate 530 to improve a moisture content of the laundry.

In addition, the cover surface 558 may include a handle 551 with which the user may hold the second pressurizing plate 550 in order to pivot the second pressurizing plate 550 in the vertical direction. Preferably, the handle 551 may be located below the cover surface 558. The handle 551 may be a simple handle, or may also perform a function of releasing lock between a locking hook 542 (see FIG. 4C) and a locking hole 547 to be described later. That is, when the handle 551 is pulled, coupling between a catch portion (not shown) located inside the lock hole 547 and the locking hook 542 may be released.

In addition, the second pressurizing plate 550 may protect side surfaces of the base plate 510 and the first pressurizing plate 530 in order to perform the cover function to protect the first pressurizing plate 530 and the base plate 510. In this case, the second pressurizing plate 550 may further include protective side surfaces 559 formed by being bent in a direction toward the door inner surface 401 from both side surfaces of the second pressurizing plate 550, respectively. To this end, a width of the second pressurizing plate 550 will be greater than a width of each of the first pressurizing plate 530 and the base plate 510.

On the door inner surface 401, the second pressurizing plate 550 may pivot (A1) in the vertical direction of the door around the second shaft 5621 formed in parallel along the width direction of the door. In one example, the second pressurizing plate 550 may also pivot in an opposite direction as shown by an arrow FIG. 4E.

The door inner surface 401 may be recessed inwardly of the door by a length corresponding to the thickness of the second pressurizing plate 550 to define therein a recessed space 402 for accommodating the second pressurizing plate 550 therein to minimize protrusion of the second pressurizing plate 550 from the door inner surface 401 when the second pressurizing plate 550 is pivoted along the width direction of the door and turned upward, that is, when the cover surface 558 faces the door inner surface 401.

FIG. 4A shows that the user opens the door 400 and the pressurizing portion 500 is exposed, and FIG. 4B shows a state in which the second pressurizing plate 550 is pivoted around the second shaft 5621 disposed along the width direction of the door and accommodated in the recessed space 402 in order for the user to mount the pants P. In addition, the pressurizing surface 555 may include a prevention groove 557 in a recessed form for preventing a sewing line of the pants P from being pressurized. The prevention groove 557 is defined in a longitudinal direction of the pressurizing surface 555, which is for preventing the sewing line (or the seam) generated during sewing of a front panel and a back panel of the pants from being pressurized when the second pressurizing plate 550 is closed. This is because, unnecessary folds may occur around the sewing line when the sewing line is pressurized because the sewing line generally protrudes than fabric of the pants.

Referring to FIGS. 4B and 4C, the first pressurizing plate 530 may be positioned between the base plate 510 and the second pressurizing plate 550. The first pressurizing plate 530 may include a first surface 535 facing the second pressurizing plate, a second surface 538 facing the base plate 510, and the first shaft 5611 disposed along the height direction of the door 400 to pivot the first pressurizing plate 530 in the vertical direction. The first shaft 5611 may pivotably couple the first pressurizing plate 530 to the door inner surface 401 or the base plate 510. The first pressurizing plate 530 may pivot (A2) in the left and right directions by the first shaft 5611. FIGS. 4A to 4E show a case in which the first shaft 5611 is disposed underneath the base plate 510 as an example. Therefore, when the second pressurizing plate 550 is pivoted upward by the second shaft 5621, the second pressurizing plate 550 may be pivoted downward by the first shaft 5611. The second pressurizing plate 550 may pivot to be fully tilted upward to be accommodated in the recessed space 402. On the other hand, the first pressurizing plate 530 may not pivot more than 90 degrees (°) even when the first pressurizing plate 530 pivots downward in order to make it convenient for the user to mount the pants P. That is, when an angle between the first pressurizing plate 530 and the base plate 510 in a state in which the first pressurizing plate 530 is coupled to the base plate 510 is 0 degrees (°), the angle between the first pressurizing plate 530 and the base plate 510 may be 90 degrees (°) when the first pressurizing plate 530 is pivoted downward and opened. Therefore, it may be easy to fix the hem of the pants using the first clip 531 after mounting the pants P on the first pressurizing plate 530.

In one example, the first pressurizing plate 530 may include a first clip 531 and a second clip 533 to fix the pants P mounted on the first pressurizing plate 530. The first clip 531 may be positioned at a lower portion of the second surface 538, and the second clip 533 may be positioned at a lower portion of the first surface 535. The first clip 531 may fix a portion of the pants including a hem of the pants. Referring to FIG. 4D, the second clip 533 may fix both sides of an opposite portion of the hem of the pants, that is, the pant waist and both sides of the pant legs connected to the pant waist.

The first pressurizing plate 530 may further include a mounting corner 539, which is a corner on which the pants P are mounted on an upper end thereof. The mounting corner 539 has a curved surface, so that the unnecessary wrinkles or folds may be prevented from being generated even when the pants P are mounted.

In addition, the mounting corner 539 may include a first curved surface 5391 (see FIG. 5B) connected to the first surface 535, and a second curved surface 5392 (see FIG. 5B) connecting the first curved surface to the second surface 538. The first curved surface 5391 (see FIG. 5B) and the second curved surface 5392 (see FIG. 5B) may have different curvatures and thus may have asymmetrical shapes. That is, the first curved surface 5391 (see FIG. 5B) may have a shape that protrudes in a direction away from the door inner surface 401 than the first surface 535. Accordingly, a radius of curvature of the first curved surface 5391 (see FIG. 5B) may be greater than that of the second curved surface 5392 (see FIG. 5B).

The first pressurizing plate 530 may further include the first opening 532 penetrating the first pressurizing plate 530 in the thickness direction of the first pressurizing plate 530. The first opening 532 may be positioned in the first pressurizing plate 530 to correspond to a position of the second opening 552 defined in the second pressurizing plate 550. This is to facilitate the penetration of the steam into the pants P through the second opening 552 when closing the second pressurizing plate 550, that is, when the second pressurizing plate 550 pivots around the second shaft and the pressurizing surface 555 of the second pressurizing plate 550 is at a position facing the first pressurizing plate 530 and the pants P.

In addition, both surfaces of the first pressurizing plate 530, that is, the first surface 535 and the second surface 538 may respectively include a first groove 536 and a second groove 537 recessed along the longitudinal direction of the first pressurizing plate 530 to prevent the sewing line of the pants P from being pressurized during the pressurization.

In one example, the first pressurizing plate 530 may include the first clip 531 and the second clip 533 for fixing the mounted pants P. The first clip 531 may be disposed on the second surface 538 and may have a U-shape. As long as no external force acts on the first clip 531, the first clip 531 may be a biased member in which a force acts only in a direction of pressurizing the laundry inserted into the clip toward the first pressurizing plate 530. For example, the first clip 531 may be the biased member made of an elastic member and using an elastic force.

The first clip 531 may include a clip fixing portion 5311 for fixedly coupling the first clip 531 to the first pressurizing plate 530, and a clip support 5312 that is bent and extended from both ends of the clip fixing portion. When the pants P are inserted into the clip support 5312, the elastic force acts toward the first pressurizing plate 530 to fix the pants P.

The second clip 533 may be located at the lower portion of the first surface 535 facing the second pressurizing plate 550 to not allow the opposite portion of the pants fixed by the first clip 531 to move. Preferably, the first clip 531 may fix the hem of the pant legs, and the second clip 533 may fix both side surfaces of the pant waist, which are the portion opposite to the hem. The second clip 533 may be formed as a clip having an angled shape, like an angled bracket. The second clip 533 may also be made of an elastic member, and fix the pants like a clamp. However, the second clip 533 may be preferably formed as a pair of angled clips respectively connected in directions of both side surfaces from the lower portion of the first surface 535. Accordingly, the second clip 533 in the angled shape may define a predetermined gap 5331 between the second clip 533 and the first surface 535. The predetermined gap 5331 may always be maintained, and both side surfaces of the pants are respectively inserted into the predetermined gaps 5331 to fix the pants P.

For the second clip 533 for fixing the pants using the predetermined gap 5331, a physical force, such as the elastic force may not act as in the first clip 531. This takes into account that lengths of the pants P mounted on the first pressurizing plate 530 are different. That is, a length of pants for adults and a length of pants for children may be different from each other. In this connection, when the positions of the first clip 531 and the second clip 533 are fixed based on the length of the pants for the adults, there may be a problem in that the pants for the children are not able to be fixed. Therefore, when the first clip 531 is fixed, the position of the second clip 533 should be variable. However, because changing the position of the second clip 533 requires another component, a thickness of the first pressurizing plate 530 increases and the apparatus becomes complicated. To solve this simply, the second clip 533 may insert both side surfaces of the pants P therein and fix both side surface of the pants P at both side surfaces of the first pressurizing plate 530, rather than fixing the ends of the pants P being mounted.

The base plate 510 may further include the locking hook 542 for coupling with the second pressurizing plate 550. Although the locking hook 542 is illustrated as having an angled shape as an example, any shape may be used as long as the locking hook 542 is able to couple and separate the base plate 510 and the second pressurizing plate 550. The locking hook 542 is inserted into the locking hole 547 defined in the second pressurizing plate 550 to maintain the locking between the base plate 510 and the second pressurizing plate 550. The locking hole 547 may be located in the pressurizing surface 555, and the catch portion (not shown) coupled with the locking hook 542 may be located inside the locking hole 547.

A width of the base plate 510 may be greater than a width of the first pressurizing plate 530. Accordingly, portions that do not contact the first pressurizing plate of the coupling surface 511 that directly faces the first pressurizing plate of the base plate 510 exist near both side surfaces of the base plate 510. Because each locking hook 542 is located in the vicinity of each of the both side surfaces, when the base plate 510 and the first pressurizing plate 530 are coupled to each other, there will be no interference resulted from the locking hook 542.

Therefore, when the second pressurizing plate 550 is coupled to the base plate 510, the catch portion (not shown) located inside the locking hole 547 will come into contact with the locking hook 542 and be fastened thereto for the locking. In addition, for releasing the locking of the locking hook 542 and the catch portion, the locking hook 542 may come out of the locking hole 547 when pulling the handle 551. This is one of several possible methods. The second pressurizing plate 550 and the base plate 510 may be coupled to each other using a different method.

When the second pressurizing plate 550 and the base plate 510 are coupled to each other, the first pressurizing plate 530 positioned between the second pressurizing plate 550 and the base plate 510 may also be pressurized by the second pressurizing plate 550. Therefore, a space between the first pressurizing plate 530 and the base plate 510 may also be pressurized.

When the coupling and separation between the base plate 510 and the first pressurizing plate 530 are possible, and the coupling between the base plate 510 and the first pressurizing plate 530 may be maintained as it is, the base plate 510 and the first pressurizing plate 530 may be coupled to each other in any scheme. Alternatively, in FIGS. 6 to 7B, the first pressurizing plate 530 may further include the elastic member 5618 such as a spring for ensuring that the base plate 510 is pressed.

FIG. 4D shows a configuration in which, after mounting the pants P on the first pressurizing plate 530, the first pressurizing plate 530 is pivoted around the first shaft 5611 again to face the base plate 510. The first pressurizing plate 530 may further include a coupling member for coupling with the base plate 510. FIG. 4E shows a state in which the second pressurizing plate 550 is pivoted around the second shaft 5621 and the first pressurizing plate 530 and the base plate 510 are coupled to each other. Therefore, the pants P may be pressurized by the second pressurizing plate 550, the first pressurizing plate 530, and the base plate 510 after being mounted on the first pressurizing plate 530.

In addition, referring to FIG. 4A, the second clip 533 may be exposed to the outside even when the second pressurizing plate 550 is pivoted to face the first pressurizing plate 530 and closed. Because the second clip 533 is formed in a protruding form from the first pressurizing plate 530, in consideration of the same, a length in the height direction of the second pressurizing plate 550 may be smaller than a length in the height direction of the first pressurizing plate 530.

Although not shown in FIG. 4D, as will be described later, even when the pants of any thickness are mounted on the first pressurizing plate 530, in order to uniformly apply the pressure to the pants, a hinge hole 5613 (see FIG. 6) may be defined such that the first shaft 5611 for pivoting the first pressurizing plate 530 may not only rotate, but also move in a direction farther from or closer to the door inner surface. That is, this is because a shape of the hinge hole 5613 (see FIG. 6) is not a circular shape the same as that of the first shaft, but a shape in which semicircles are respectively coupled to both ends of a rectangle. Accordingly, the first shaft 5611 may also rotate in the hinge hole 5613 and move in the direction closer to or farther from the door inner surface along the hinge hole 5613. Such clearance structure of the hinge hole 5613 may pressurize the mounted pants no matter how great the thickness of the pants is.

Referring to FIG. 4C, the base plate 510 may include the coupling surface 511 that pressurizes the pants mounted on the first pressurizing plate, and the mounting surface 512 positioned opposite to the coupling surface 511 to couple the base plate 510 to the door inner surface 401. Instead of the base plate 510, the door inner surface 401 may serve as the base plate 510. However, preferably, the base plate 510 may be spaced apart from the door inner surface 401 by a predetermined distance, and the base plate 510 may be coupled to the door inner surface using a support member (not shown). The support member may be an elastic member. This is to maintain a constant pressurizing force between the base plate 510 and the first pressurizing plate 530 to closely adhere the pants P.

When in close contact with the first pressurizing plate 530 without the mounted pants P, in order to prevent damage to the base plate 510 by the first clip 531 protruding from the first pressurizing plate 530, the base plate 510 may further include a clip accommodating portion 513 that is recessed into a shape corresponding to a shape of the first clip to accommodate the first clip 531 therein. The clip accommodating portion 513 may be in a recessed form or may be in a completely penetrated form.

Considering that the first clip 531 is located at the lower portion of the first pressurizing plate 530, the clip accommodating portion 513 may also be positioned at a lower portion of the base plate 510. Because the clip fixing portion 5311 of the first clip is located at the lower portion of the first pressurizing plate, a portion of the base plate corresponding to a portion of the clip accommodating portion 513 corresponding to the clip fixing portion of the first clip may be shorter than another portion of the base plate 510. That is, a first length P1 of the portion of the base plate corresponding to the clip fixing portion 5311 may be smaller than a second length P2 of another portion of the base plate.

Although not shown in the drawing, in order not to pressurize the sewing line of the pants P that is pressurized between the first pressurizing plate 530 and the base plate 510, the base plate 510 may also include a pressurizing prevention groove (not shown) defined therein at a position corresponding to the second groove 537 of the first pressurizing plate 530.

Figure 5A:
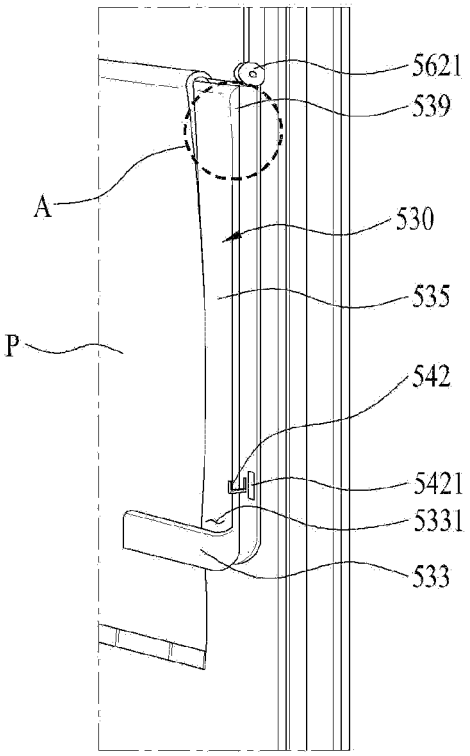
FIG. 5A shows that a mounting corner of a first pressurizing plate has an asymmetrical cross-section.
Figure 5B:
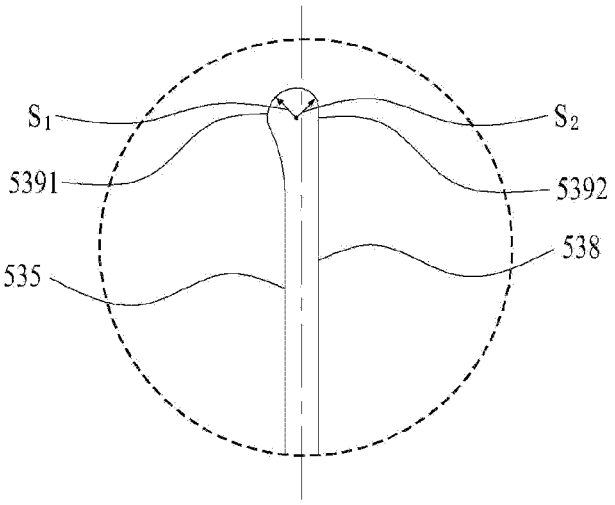
FIG. 5B is an enlarged view of a mounting corner.

FIG. 5A shows that the mounting corner 539 has an asymmetrical cross-section, and FIG. 5B is an enlarged view of the mounting corner 539.

Referring to FIG. 5A, the hem of the pants P may be fixed by the first clip 531 located on the second surface 538, and a middle portion of the pants may be mounted by a smooth curved surface of the mounting corner 539. Thereafter, the rest of the pants P may be mounted on the first surface 535. The rest of the pants P is longer than the first pressurizing plate 530, so that a portion of the pant waist of the pants P may be located below the lower portion of the first pressurizing plate 530. Therefore, the second clip 533 may insert both side surfaces of the pants respectively into the predetermined gaps 5331 and fix the both side surfaces of the pants without fixing the end of the pants P.

Because the mounting corner 539 has the curved surface, the unnecessary wrinkles or folds may be prevented from being generated even when the pants P are mounted.

In addition, a portion of the locking hook 542 disposed on the base plate 510 may be disposed inside the base plate 510 through an accommodating hole 5421. This is because, when the locking hook 542 is made of a material, for example, metal, different from that of the base plate 510 for durability, the locking hook 542 should be coupled to the base plate 510, and the locking hook 542 is able to be coupled to the mounting surface, which is the rear surface of the base plate 510, or the interior of the base plate 510 using the fastening member for the sake of aesthetics.

Referring to FIG. 5B, the mounting corner 539 may include the first curved surface 5391 connected to the first surface 535, and the second curved surface 5392 connecting the first curved surface 5391 to the second surface 538. The first curved surface 5391 and the second curved surface 5392 may have the different curvatures and thus may have the asymmetrical shapes. That is, the first curved surface 5391 may have the shape that protrudes in the direction away from the door inner surface 401 than the first surface 535. Therefore, when a center of the first pressurizing plate is indicated by a dashed-dotted line, a radius of curvature S1 of the first curved surface 5391 may be greater than a radius of curvature S2 of the second curved surface 5392 based on the dashed-dotted line. In other words, a curvature of the first curved surface 5391 may be smaller than a curvature of the second curved surface 5392. The radius of curvature of the second curved surface 5392 is similar to half the thickness of the first pressurizing plate 530, but the radius of curvature of the first curved surface 5391 may be greater than half the thickness of the first pressurizing plate 530.

In one example, the total length (a length of an outer seam) of the pants P may be greater than a sum of a length of the first surface 535, a length of the mounting corner 539, and a length of the second surface 538. In this case, the pant waist of the pants may be located lower the second clip 533. From the hem of the pants P to a middle portion of the pant leg will be pressurized through the base plate 510 and the second surface, and the rest of the pants including the pant waist (the portion excluding the pant legs) of the pants will be mounted on the first surface 535 after passing through the mounting corner 539. In this connection, a portion to actually remove the folds is not the pant waist, but the pant legs. In addition, a position of the sewing line the pant waist may be different from that of the pant legs. Therefore, a place where the wrinkle removal through actual pressurizing is required will be the pant legs except for the pant waist.

Therefore, by increasing the radius of curvature of the first curved surface 5391 in order to pressurize only a desired portion of the mounted pants P, the portion of the pants located between the second surface 538 and the base plate 510 is all pressurized to remove the folds, and a tension is generated by a self load of the rest of the pants past the mounting corner 539, so that the pants will be pressurized in a very straight and taut state throughout, which will make the intended wrinkles (the creases) of the pants clearer and more prominent. Such creases are also referred to as "clearly visible pants' leg creases".

Considering the radius of curvature of the first curved surface 5391, after passing through the first curved surface 5391, the pants P will be spaced apart from the first pressurizing plate 530 unless the second pressurizing plate 550 is coupled to the first pressurizing plate 530. In one example, depending on a shape of the second pressurizing plate 550, the portion of the pants P located between the first surface 535 and the second pressurizing plate 550 may also be pressurized.

Figure 6:
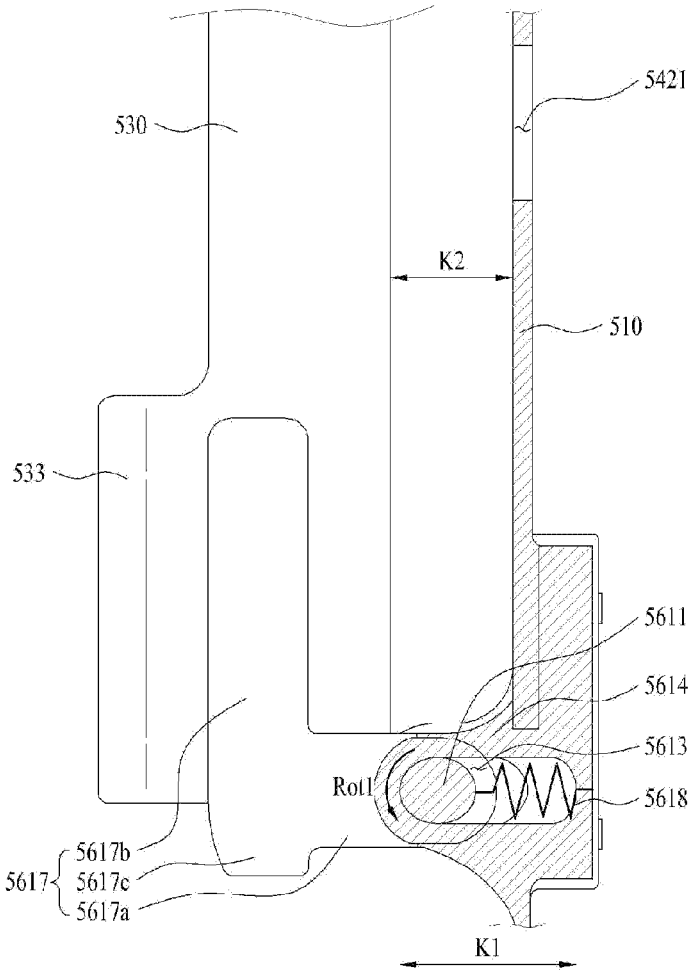
FIG. 6 shows an example of a hinge portion.

FIG. 6 shows an example of a hinge portion 561. The pants may be mounted between the base plate 510 and the first pressurizing plate 530. In addition, the base plate 510 further includes an accommodating hole 5421 through which the locking hook 542 for locking the second pressurizing plate 550 by being coupled to the second pressurizing plate 550 passes. The base plate 510 may not be attached to the door inner surface 401, but may be spaced apart therefrom by a predetermined distance. This is to maintain a constant pressing force between the base plate 510 and the first pressurizing plate 530 to be in close contact with the pants P. In addition, this is to provide a space in which a portion of the hinge portion 561 may be inserted at a location between the base plate 510 and the door inner surface 401 as shown in FIG. 6.

A second clip 533 for fixing the pant waist of the pants on both side surfaces may be disposed on the first surface 535 of the first pressurizing plate 530. In addition, the hinge portion 561 may be connected to a side surface on which the second clip 533 is located among both side surfaces of the first pressurizing plate 530. In addition, the hinge portion 561 may be connected to a lower end of the base plate 510.

The hinge portion 561 may pivotably connect the first pressurizing plate 530 and the base plate 510 to each other. Because the base plate 510 is at a fixed position, the first pressurizing plate 530 will pivot. To this end, the hinge portion 561 may include the first shaft 5611 for pivoting the first pressurizing plate 530 in the width direction of the door. Thus, the first pressurizing plate 530 may pivot in the vertical direction of the door.

In addition, the hinge portion 561 may move the first shaft 5611 in the direction farther from or closer to the door inner surface 401. When the direction farther from or closer to the door inner surface 401 is referred to as the thickness direction of the door, the first shaft 5611 is movable along the thickness direction of the door. That is, the first shaft 5611 is movable along the thickness direction of the door at the same time as the pivoting.

The hinge portion 561 may further include a hinge support 5614 coupled to the base plate 510 or the door inner surface 401 to support the first shaft 5611, and the hinge hole 5613 into which the first shaft 5611 is inserted by passing through the hinge support 5614 in an axial direction of the first shaft 5611. A length of the hinge hole 5613 along the direction farther from or closer to the door inner surface 401 may be greater than a length of the hinge hole 5613 measured along the height direction of the door 400.

That is, because the hole into which the first shaft 5611 is inserted is defined in a shape of a figure in which the semicircles are respectively coupled to the both sides of the rectangle (or a shape of a symbol indicating start/end in a flowchart), the length of the hinge hole 5613 in the thickness direction of the door may be greater than a diameter of the first shaft 5611. Accordingly, the first shaft 5611 inserted into the hinge hole 5613 is movable within the hinge hole 5613 along the thickness direction of the door 400.

An example of the hinge portion 561 shown in FIG. 6 shows that the hinge portion 561 is pivotally coupled to the base plate 510 and the first pressurizing plate 530 at the lower end of the base plate 510. The first shaft 5611 may be formed as one shaft from one side to the other side of the first pressurizing plate 530 along the width direction of the door 400. That is, one hinge portion 561 may be composed of one first shaft. However, there may be a plurality of hinge portions 561 underneath the base plate 510 as shown in FIG. 1B or FIG. 4C. Hereinafter, one of the plurality of hinge portions 561 will be described as an example.

The hinge support 5614 may pivotably connect the first shaft 5611 to the base plate 510. The hinge support 5614 may further include the hinge hole 5613 into which the first shaft 5611 is inserted by passing through the hinge support 5614 in the axial direction of the first shaft 5611, that is, in the width direction of the door. The length of the hinge hole 5613 along the direction farther from or closer to the door inner surface 401 may be greater than the length of the hinge hole 5613 measured along the height direction of the door 400.

The shape of the hinge hole may be the shape in which the semicircles are respectively connected to two short sides of the rectangle. Accordingly, the first shaft 5611 may be movable along a long side of the rectangle. That is, the first shaft 5611 may move in the direction farther from or closer to the door inner surface 401. Thus, a space V may be defined between the base plate 510 and the first pressurizing plate 530. A distance between the base plate 510 and the first pressurizing plate 530 in the space V may vary whenever the first shaft 5611 moves. The first shaft 5611 may move by a distance excluding a diameter of the first shaft 5611 from the length of the hinge hole 5613 indicated by K1, which means that the first pressurizing plate 530 may move by a distance indicated by a distance K2.

Because the length of K2 also varies based on the length of K1, it will be possible to set a length of S1 based on the thickness of the pants P that may be mounted between the first pressurizing plate 530 and the base plate 510. FIG. 6 shows that the first pressurizing plate 530 and the base plate 510 are close to each other enough to be in close contact with each other, but this may vary depending on the design.

The elastic member 5618 may be connected to the first shaft 5611. The elastic member 5618 may be constructed to connect the first shaft and the hinge support to each other, and to allow the first shaft 5611 to always receive the elastic force in the direction farther from the door inner surface 401. Alternatively, the first shaft 5611 may be constructed to receive the elastic force in the direction closer to the door inner surface 401 for the close contact between the first pressurizing plate 530 and the base plate 510, but this is inconvenient in that the user has to apply a force in a direction opposite to the elastic force whenever the user pivots the first pressurizing plate 530. Thus, herein, the case in which the elastic force is applied in the direction farther from the door inner surface 401 is shown. In this case, when the second pressurizing plate 550 pivots downward and is coupled to the base plate 510 by the locking hook 542 and the catch portion (not shown), the first pressurizing plate may be designed to receive a pressing force at a location between the second pressurizing plate 550 and the base plate 510. In this connection, the elastic member 5618 will be compressed, and, when the second pressurizing plate 550 is pivoted upward and opened, will push the first pressurizing plate 530 out to allow the first pressurizing plate 530 and the base plate 510 to be spaced apart from each other.

Therefore, when the second pressurizing plate 550 is closed, the first pressurizing plate 530 will receive a force in the direction farther from the door inner surface 401 by the elastic force of the elastic member 5618, but the second pressurizing plate 550 will pressurize the first pressurizing plate 530. Thus, the portion of the pants P mounted between the first pressurizing plate 530 and the base plate 510 may be pressurized. In addition, because an entire surface of the first pressurizing plate 530, not a specific portion thereof, comes into close contact with the pants P at the same time, the pants P may be uniformly contacted. The user may fix the pants P through the first clip 531 after pivoting (Rot1) the first pressurizing plate 530 downward. In addition, when the first pressurizing plate 530 is pulled while pivoting the first pressurizing plate 530 in the opposite direction again, the space V between the base plate 510 and the first pressurizing plate 530 will be defined. When the user gently puts the first pressurizing plate 530 down after the base plate 510 and the first pressurizing plate 530 face each other, as the first pressurizing plate 530 approaches the base plate 510, the pants positioned between the first pressurizing plate 530 and the base plate 510 will be pressurized simultaneously and uniformly.

A hinge connecting portion 5617 may connect the first shaft 5611 and the first pressurizing plate 530 to each other. The hinge connecting portion 5617 may be in an angled-shape, and an angle thereof may be close to a right angle. Specifically, the hinge connecting portion 5617 may include a first wing 5617*a* fixedly coupled to the first shaft 5611 and pivoting together, and a second wing 5617*b* vertically or obliquely connected to the first wing 5617*a*.

Accordingly, when the first shaft 5611 rotates (Rot1) in the downward direction, the hinge connecting portion 5617 may also pivot. Specifically, when the first shaft 5611 rotates, the first wing 5617*a* may also pivot, and the second wing 5617*b* may also pivot. Accordingly, when the first pressurizing plate 530 pivots (Rot1) in the downward direction, the first wing 5617*a* including a portion where the first wing 5617*a* and the second wing 5617*b* meet will be in contact with the door inner surface 401. Accordingly, the first pressurizing plate 530 will stop and no longer pivot. Roughly, the angle between the base plate 510 and the first pressurizing plate 530 may be 90 degrees (°).

The hinge connecting portion 5617 may further include a third wing 5617*c* protruding in a region where the first wing 5617*a* and the second wing 5617*b* meet. This is because it is more efficient that the third wing 5617*c* comes into contact first when the hinge connecting portion 5617 pivots and comes into contact with the door inner surface 401 than when an entirety of the wing contacts. In addition, the angle between the base plate 510 and the first pressurizing plate 530 will be more precisely designed.

As a result, the hinge connecting portion 5617 in the angled form may prevent the first pressurizing plate 530 from pivoting exceeding a predetermined angle. Preferably, the predetermined angle may be 90 degrees (°).

Figure 7A:
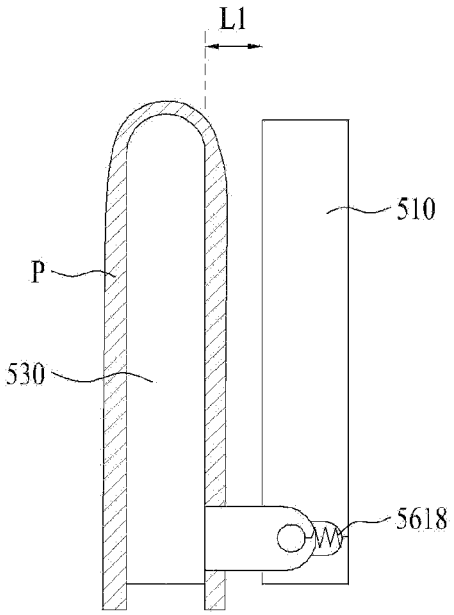
FIGS. 7A and 7B show positions of a first pressurizing plate based on opening and closing of a second pressurizing plate.
Figure 7B:
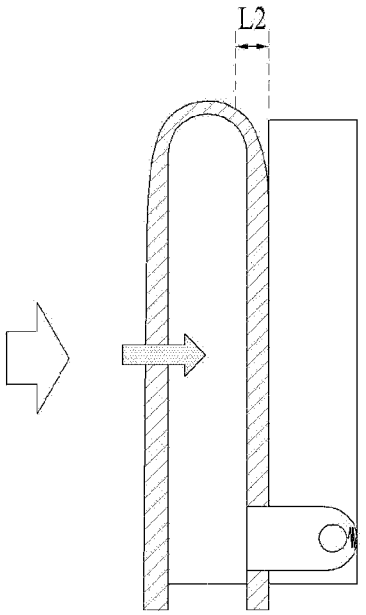

FIGS. 7A and 7B show positions of the first pressurizing plate based on opening and closing of the second pressurizing plate. After the second pressurizing plate 550 is opened, the first pressurizing plate 530 will pivot downward to mount and fix the pants P. Thereafter, by pivoting the first pressurizing plate 530 in the opposite direction, the first pressurizing plate 530 may be disposed to face the base plate 510 as shown in FIG. 7A. In this connection, as described above, the first shaft 5611 of the first pressurizing plate 530 may move in the direction closer to or farther from the door inner surface 401 by the shape of the hinge hole 5613. FIG. 7A shows a case in which the first pressurizing plate 530 is moved maximally away from the door inner surface 401 by the elastic force of the elastic member 5618 when the second pressurizing plate 550 is opened. Therefore, L1 indicates a distance between the first pressurizing plate 530 and the base plate 510 when the second pressurizing plate 550 pivots upward through the second shaft 5621.

Therefore, even when the first pressurizing plate 530 is pivoted to face the base plate 510 after mounting the pants, unless an external force acts by the user, the distance of L1 will be maintained by the elastic force of the elastic member 5618. Only when the second pressurizing plate 550 is pivoted downward and coupled to the base plate 510, an entirety of the first pressurizing plate 530 moves at the same time toward the base plate 510 by the second pressurizing plate 550 in a direction of an arrow in FIG. 7B, so that even pressure may be applied to the pants.

When the second pressurizing plate 550 is closed, the first pressurizing plate 530 is moved toward the base plate 510 by the second pressurizing plate 550, the pants positioned between the first pressurizing plate 530 and the base plate 510 will be pressurized. In this connection, the elastic member 5618 may be compressed to apply the elastic force in the opposite direction as in FIG. 7B. However, the second pressurizing plate 550 may overcome the elastic force of the elastic member 5618 by maintaining the locking state by the locking hook 542 and the catch portion (not shown). In this connection, the distance between the first pressurizing plate 530 and the base plate 510 is L2, which may be variable depending on the thickness of the pants.

The present disclosure is able to be implemented in various forms, so that a scope thereof is not limited to the above-described embodiment. Therefore, when the modified embodiment includes the components in claims of the present disclosure, the modified embodiment should be viewed as belonging to the scope of the present disclosure.

What is claimed is:

1. A laundry treating apparatus comprising:

a cabinet having a laundry inlet defined in one surface thereof;

a first chamber positioned inside the cabinet and configured to accommodate laundry therein through the laundry inlet;

a second chamber that is positioned underneath the first chamber and defines a space separated from a space of the first chamber;

a steamer disposed inside the second chamber and configured to generate steam and to supply the generated steam to the first chamber;

a door pivotably coupled to the cabinet and configured to open and close the laundry inlet, the door having a door inner surface facing the first chamber;

a base plate coupled to the door inner surface;

a first pressurizing plate that is rotatably coupled to the door inner surface and that is configured to rotate upward and downward; and a second pressurizing plate that is rotatably coupled to the door inner surface and that is configured to rotate upward and downward, the second pressurizing plate being configured to press the laundry disposed on the first pressuring plate or the base plate, wherein at least one of the first pressurizing plate or the second pressurizing plate is configured to:

based on rotating downward, be separated from the base plate, and based on rotating upward, press the laundry toward the base plate.

2. The laundry treating apparatus of claim 1, wherein the first pressurizing plate is configured to rotate between a first position for fixing pants and a second position for treating the pants, wherein the first pressurizing plate is configured to support the pants based on the first pressurizing plate being positioned at the first position in which a portion of the pants is located between the first pressurizing plate and the base plate, and wherein the pants are pressed by the first pressurizing plate and the second pressurizing plate.

3. The laundry treating apparatus of claim 1, wherein the first pressurizing plate is configured to rotate within 90 degrees.

4. The laundry treating apparatus of claim 1, further comprising:

a first shaft that is disposed parallel to a width direction of the door and that rotatably couples the first pressurizing plate to the base plate; and a second shaft that is disposed parallel to the first shaft and rotatably couples the second pressurizing plate to the base plate, wherein the first shaft is located on one of an upper end and a lower end of the base plate, wherein the second shaft is located on the other of the upper end and the lower end of the base plate.

5. The laundry treating apparatus of claim 4, wherein the first pressurizing plate includes:

a first clip located at a lower portion of one surface thereof facing the base plate, wherein the first clip fixes one of a hem and a pant waist of the pants; and/or a second clip located at a lower portion of the other surface thereof facing the second pressurizing plate, wherein the second clip fixes the other of the hem and the pant waist of the pants.

6. The laundry treating apparatus of claim 5, wherein a length of the second pressurizing plate is smaller than a length of the first pressurizing plate, and the second clip is exposed out of the first pressurizing plate when the second pressurizing plate is pivotably coupled to the first pressurizing plate.

7. The laundry treating apparatus of claim 5, wherein the first pressurizing plate includes:

a first surface that is one surface facing the base plate;

a second surface that is the other surface facing the second pressurizing plate; and a mounting corner including a first curved surface and a second curved surface for connecting the first surface and the second surface to each other, wherein the mounting corner mounts the pants, wherein a curvature of the first curved surface connected to the first surface is different from a curvature of the second curved surface connected to the second surface.

8. The laundry treating apparatus of claim 7, wherein the first curved surface protrudes toward the second pressurizing plate.

9. The laundry treating apparatus of claim 8, wherein the first surface includes a first groove recessed in a longitudinal direction of the door to prevent interference with a seam formed on the pants, and/or wherein the second surface includes a second groove recessed in the longitudinal direction of the door to prevent the interference with the seam formed on the pants.

10. The laundry treating apparatus of claim 1, wherein a width of the second pressurizing plate is greater than widths of the first pressurizing plate and the base plate.

11. The laundry treating apparatus of claim 10, further comprising:

a blower disposed inside the second chamber to suck air in the first chamber;

a heat pump disposed inside the second chamber to dehumidify and heat the sucked air;

a first opening penetrating the first pressurizing plate; and a second opening penetrating the second pressurizing plate at a position corresponding to a position of the first opening, wherein the first opening and the second opening are configured to expose the laundry to dehumidified and heated air and steam.

12. The laundry treating apparatus of claim 11, wherein the second pressurizing plate includes protective side surfaces formed by being bent in a direction toward the door inner surface from both side surfaces of the second pressurizing plate, respectively, wherein the protective side surfaces cover both side surfaces of the base plate and both side surfaces of the first pressurizing plate when the second pressurizing plate pressurizes the first pressurizing plate and the base plate.

13. The laundry treating apparatus of claim 12, further comprising a cover surface that is located on a side away from the door inner surface among both surfaces of the second pressurizing plate, and the cover surface further includes a handle for a user to hold the second pressurizing plate to pivot the second pressurizing plate.

14. The laundry treating apparatus of claim 4, wherein the first pressurizing plate includes a hinge portion including the first shaft, wherein the hinge portion is disposed beneath the first pressurizing plate to move the first pressurizing plate in a direction farther from or closer to the door inner surface.

15. The laundry treating apparatus of claim 14, wherein the hinge portion further includes a hinge connecting portion of an angled shape for connecting the first shaft and the first pressurizing plate to each other, wherein the hinge connecting portion prevents the first pressurizing plate from pivoting by an angle equal to or greater than a predetermined angle when the first pressurizing plate pivots in a direction farther from the base plate.

16. The laundry treating apparatus of claim 1, wherein the first pressurizing plate is configured to:

based on rotating downward, be separated from the base plate; and based on rotating upward, press a portion of the laundry on the first pressurizing plate toward the base plate.

17. The laundry treating apparatus of claim 16, wherein the second pressurizing plate is configured to, based on rotating downward in a state in which the first pressurizing plate has rotated upward, be separated from the base plate and press another portion of the laundry on the first pressurizing plate toward the base plate.

* * * * *